US006314265B1

(12) United States Patent
Kuermeier et al.

(10) Patent No.: US 6,314,265 B1
(45) Date of Patent: Nov. 6, 2001

(54) TRANSFER PRINTING STATION FOR AN ELECTROGRAPHIC DEVICE WITH A CONTACT PRESSURE ELEMENT IN THE TRANSFER PRINTING AREA

(75) Inventors: Christian Kuermeier, Munich; Alexander Kreiter, Woerth; Alex Windhager, Ashau am Inn; Stefan Brecht, Munich; Anton Stuerzer, Grafing; Friedrich Meschenmoser, Grassbrunn, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/530,978

(22) PCT Filed: Nov. 5, 1998

(86) PCT No.: PCT/EP98/07065

§ 371 Date: Jun. 28, 2000

§ 102(e) Date: Jun. 28, 2000

(87) PCT Pub. No.: WO99/24876

PCT Pub. Date: May 20, 1999

(30) Foreign Application Priority Data

Nov. 7, 1997 (DE) ..... 197 49 386

(51) Int. Cl.[7] ..... G03G 15/16
(52) U.S. Cl. ..... 399/317; 399/311
(58) Field of Search ..... 399/310, 311, 399/316, 317, 308

(56) References Cited

U.S. PATENT DOCUMENTS

| | | | | |
|---|---|---|---|---|
| 4,110,027 | | 8/1978 | Sato et al. | 399/317 |
| 4,392,738 | * | 7/1983 | Fujino et al. | 399/317 |
| 5,138,396 | * | 8/1992 | Satou et al. | 399/316 |
| 5,400,125 | | 3/1995 | Stuerzer et al. | 399/309 |
| 5,424,818 | * | 6/1995 | Yoshimura et al. | 399/316 X |
| 5,581,338 | * | 12/1996 | Nakamichi et al. | 399/310 |
| 5,937,259 | * | 8/1999 | Kopp et al. | 399/316 X |

FOREIGN PATENT DOCUMENTS

| | | |
|---|---|---|
| 26 36 326 A1 | 2/1978 | (DE) . |
| 42 13 236 C2 | 11/1992 | (DE) . |
| 93 14 937 | 1/1994 | (DE) . |
| 195 41 061 C1 | 11/1996 | (DE) . |
| 55076367 | 6/1980 | (EP) . |

OTHER PUBLICATIONS

Japanese Abstract, 07084468, Mar. 31, 1995.

Japanese Abstract, 55076367, Jun. 9, 1980.

* cited by examiner

*Primary Examiner*—Fred L Braun
(74) *Attorney, Agent, or Firm*—Schiff Hardin & Waite

(57) ABSTRACT

A printer or copier has a transfer printing station for electrostatic transfer of toner from a photoconductor to the recording medium. A pressure contact element is provided on the recording medium guide elements to ensure contact of the recording medium with the photoconductor during transfer. Supporting rollers of a slightly greater diameter than the pressure contact element are provided at each end thereof bearing on the photoconductor as spacer elements to define a minimum spacing between the pressure contact element and the intermediate carrier. The contact pressure element(s) may also be mounted on pivotable levers movable by an eccentric.

19 Claims, 7 Drawing Sheets

FIG. 1
(PRIOR ART)
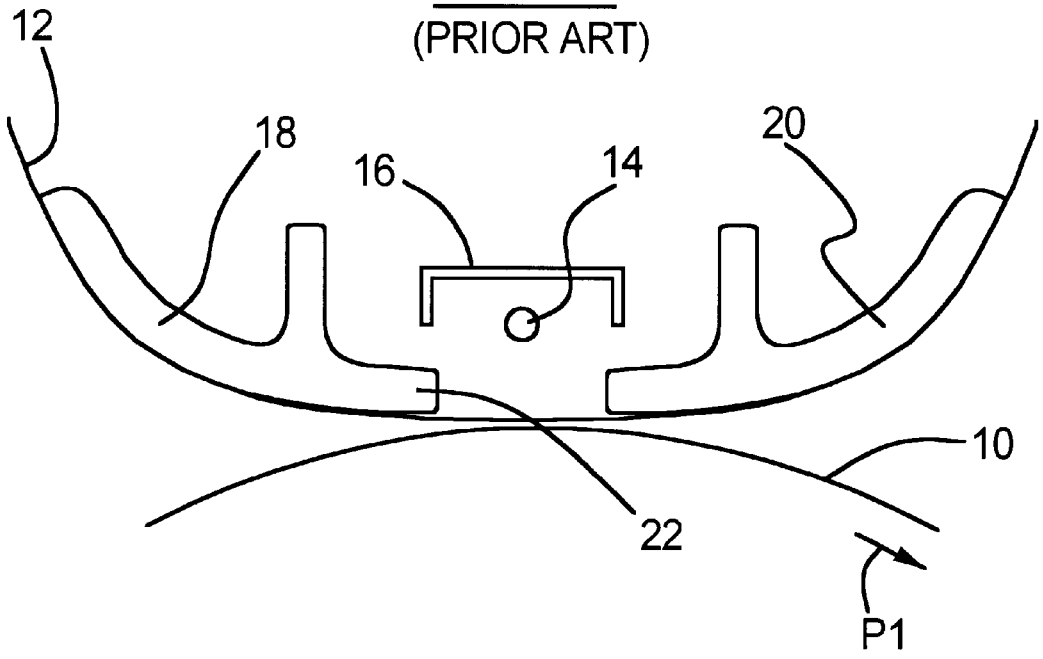
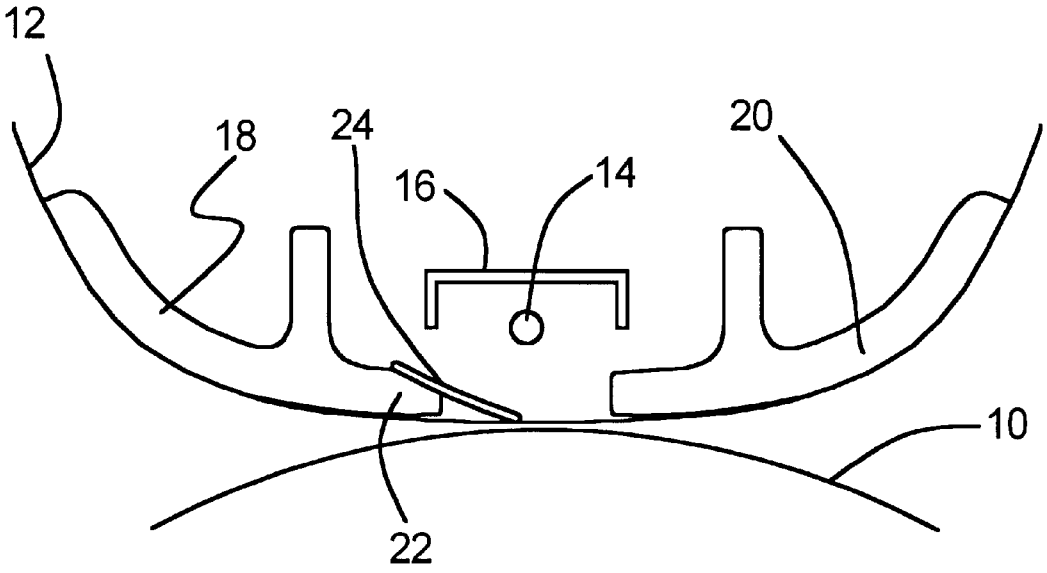
FIG. 2
(PRIOR ART)

FIG. 7
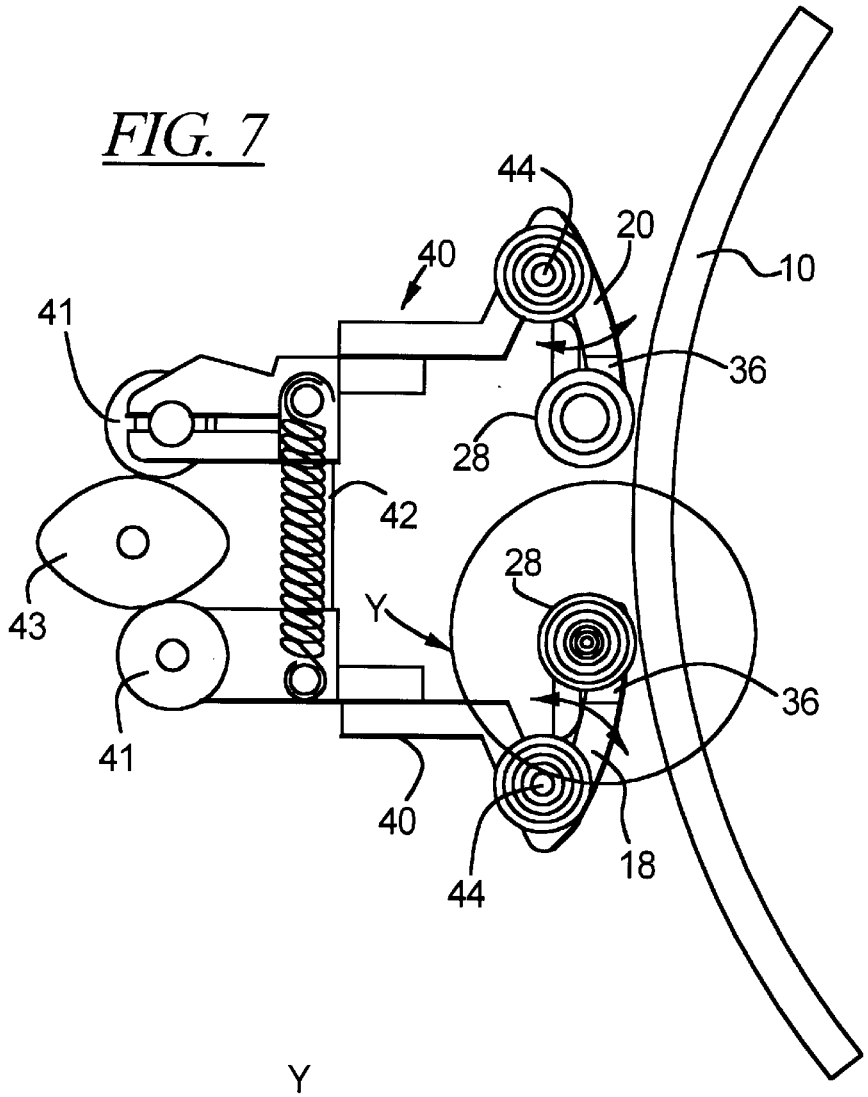
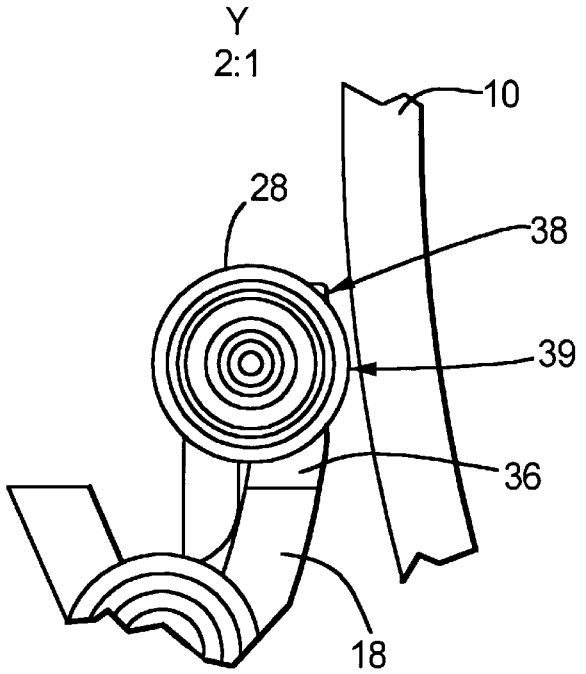
FIG. 8

TRANSFER PRINTING STATION FOR AN ELECTROGRAPHIC DEVICE WITH A CONTACT PRESSURE ELEMENT IN THE TRANSFER PRINTING AREA

BACKGROUND OF THE INVENTION

1. Field of the Invention

The present invention is directed to a transfer printing station with an electrostatic transfer printing means for transferring a toner image generated on an electrographic intermediate carrier onto at least one recording medium in a transfer printing area of the transfer printing station, with guide elements arranged in the transfer printing area for guiding the recording medium close to the intermediate carrier during the transfer printing event, and with a contact pressure element arranged between the guide elements that presses the recording medium against the intermediate carrier during the transfer printing event.

2. Description of the Related Art

Such a transfer printing station is disclosed by U.S. Pat. No. 5,400,125. It employs a leaf-shaped blade as a contact pressure element, the edge thereof pressing the web-shaped recording medium against the electrographic intermediate carrier, a photoconductor drum. Although relatively good practical results have been capable of being achieved with this solution, a few disadvantages nonetheless derive. Thus, the blade-shaped contact pressure element is a wear part whose service life is relatively short and that requires frequent replacement. Since the blade edge of the contact pressure element rubs against the recording medium, considerable contamination due to toner abrasion and paper abrasion derives in the transfer printing area. When different web widths of the recording medium are employed, then a contact pressure element matched to this web width must be utilized. Due to the blade-shaped contact pressure element, moreover, irregularities in the electrostatic field derive in the transfer printing area; these irregularities can produce stripes in the print image.

Japanese Patent document discloses a transfer printing station with a contact pressure element in the transfer printing area. The contact pressure element is fashioned at a guide element, whereby the transfer printing station contains only a single guide element. The contact pressure element is fashioned a as contact pressure roller and has lateral supporting wheels that are supported on edge regions of an intermediate carrier that have no image-generating function. The recording medium is supplied with an edge close to a supporting wheel. The other supporting wheel has a larger diameter than the first-cited supporting wheel, as a result whereof a wedge-shaped gap forms between the surface of the contact pressure roller and the surface of the intermediate carrier. What is thereby achieved is that the contact pressure roller is not charged with toner material in the area of the enlarged gap.

German Patent document discloses an electrographic printer wherein two webs of a recording medium lying side-by-side are simultaneously printed. One of the webs can have already undergone a fixing process.

SUMMARY OF THE INVENTION

An object of the present invention is to fashion a transfer printing station of the species initially cited such that, on the one hand, non-uniformly shaped recording media of different thickness or width can also be uniformly placed against the recording medium during transfer printing in order to produce a print image with high quality via the contact pressure element, and such that, on the other hand, it is assured in all operating conditions that the contact pressure element does not enter into contact with the intermediate carrier.

This object and others are achieved by a transfer printing station for an electrographic printer or copier device having: an electrostatic transfer printing means for transferring a toner image generated on an electrographic intermediate carrier onto at least one recording medium in a transfer printing area of the transfer printing station, guide elements arranged in the transfer printing area for guiding the recording medium close to the intermediate carrier during the transfer printing event, at least one contact pressure element that is resistant to bending, arranged between the guide elements displaceable relative to the intermediate carrier opposite a spring power, and that presses the at least one recording medium against the intermediate carrier during the transfer printing event, and with at least one spacer element allocated to the contact pressure element and supported on the intermediate carrier for maintaining a defined minimum spacing between contact pressure element and intermediate carrier, whereby the contact pressure element is fashioned as contact pressure rail.

The contact pressure element, which is fashioned as a contact pressure roller or as a contact pressure rail and essentially extends over the entire width of the electrographic intermediate carrier, for example a photoconductor drum, is fashioned resistant to bending and comprises a spacer element, preferably in the form of a supporting roller, supported on the intermediate carrier for maintaining a defined minimum spacing between the contact pressure element and the intermediate carrier.

The force of the contact pressure can be increased due to the resistance to bending in combination with the distance-securing function of the spacer element, so that a rippled recording medium can also be pressed smoothly against the electrographic intermediate carrier. What the increased pressing power also effects is that no air cushion can form between the recording medium and the intermediate carrier, as has often occurred in the Prior Art devices.

When the contact pressure element is fashioned as a contact pressure roller, it rolls over the recording medium and only rolling friction arises between the recording medium and the contact pressure roller. Accordingly, the abrasion at the recording medium is reduced and the risk of contamination is low.

According to a development of the invention, the surface of the contact pressure element is electrically conductive and has a predetermined electrical potential, preferably ground potential. In this way, electrical charges that arc generated on the surface of the recording medium by electrostatic charging arc collected and eliminated to ground. A disturbance of the electrical field in the transfer printing area is thus avoided.

A preferred exemplary embodiment of the invention is characterized in that the contact pressure element has two supporting rollers whose diameters are dimensioned such that a minimum spacing between the contact pressure element and the intermediate carrier is not downwardly transgressed. The rolling of the supporting rollers on defined sections of the intermediate carrier outside the actual writing area assures that the contact pressure element is always held in a defined position relative to the recording medium even given a lack of roundness and ripple of the intermediate carrier. Deviations in shape of a photoconductor drum such as, for example, lack of roundness and ripple do not, given the present invention, lead to the pressing position of the recording medium against the photo-sensitive surface of the intermediate carrier changing.

A preferred employment of the transfer printing station is characterized in that the web has already undergone a transfer printing procedure, i.e. is provided with a toner image, and has been conveyed over a longer conveying path and been potentially subjected to a thermal fixing. Ripples and grooves can form on the recording medium due to the renewed thermal fixing, these potentially leading to a deteriorated print image. By employing the invention, these ripples and grooves are smoothed in the transfer printing area, so that the recording medium lies flush against the intermediate carrier for the transfer of toner.

BRIEF DESCRIPTION OF THE DRAWINGS

Exemplary embodiments of the invention as well as a relevant Prior Art are explained below with reference to the drawings.

FIG. 1 is a side sectional view of the schematic structure of a known transfer printing station in the transfer printing area;

FIG. 2 a solution of the Prior Art having a blade-like contact pressure element;

FIG. 7 is a schematic, sectional view of an embodiment of a transfer printing station with a contact pressure rail with appertaining supporting rollers as part of the transfer printing jaw;

FIG. 8 is a partial view of the transfer printing station according to FIG. 7 in the transfer printing area.

DETAILED DESCRIPTION OF THE PREFERRED EMBODIMENTS

Figure 3:
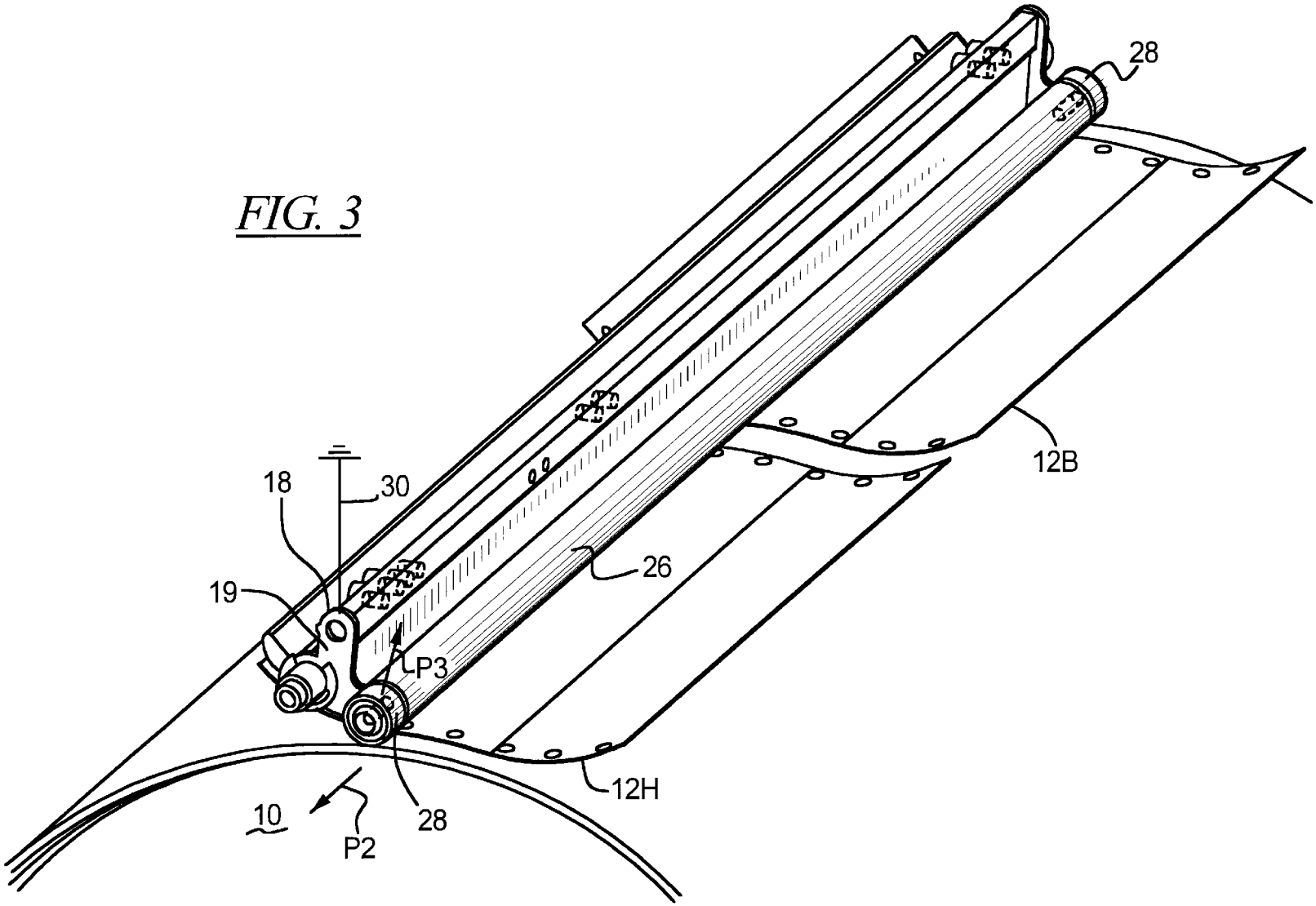
FIG. 3 is a perspective view of an exemplary embodiment of the invention with contact pressure rollers and supporting rollers.

FIG. 1 shows a part of an electrophotographic printer means that contains a transfer printing station schematically shown in the Figure. This transfer printing station serves the purpose of transferring a toner image generated on a photoconductor drum 10 onto a web-shaped recording medium, a smooth or pre folded continuous form paper 12 in the present case. This procedure is referred to as transfer printing. The transfer printing ensues within the scope of an electrophotographic process, whereby the photoconductor drum 10 is first uniformly charged to approximately 500 V with the assistance of a charging device (not shown) and is then discharged into the region of approximately 70 V in locations with the assistance of an illumination means that is controlled character-dependent. A latent character image generated in this way is then inked in a developer station (not shown) in the standard way with the assistance of a two-component mixture of toner particles and ferromagnetic carrier particles.

The toner particles are triboelectrically positively charged. A field arises between a developer drum of the developer station, which lies at a basic potential of approximately 220 V, and the regions of the latent character image discharged to approximately 70 V, as a result whereof the toner particles agglomerate on the discharged regions. The toner particles are repelled by the non-exposed area having a charge voltage of approximately 500 V.

The toner image of loose toner particles generated in this way is then transferred onto the web-shaped recording medium 12 with the assistance of a highly negative electrostatic field generated by a corotron wire 14. The corotron wire 14 is shielded at one side by a corotron shield 16; its electrical field takes effect through the aperture between two transfer printing jaws 18 and 20, passing through the recording medium 12, as a result whereof the toner particles are stripped from the photoconductor drum 10 and transferred onto the recording medium 12 having touch contact with the photoconductor 10, electrostatically adhering thereto. Subsequently, the toner images transferred in this way are fused into the surface of the recording medium 12 between a heated fixing drum and a contact pressure drum in a thermal pressure fixing station (not shown). The remaining particles that still adhere to the photoconductor drum 10 after the transfer printing are removed in a standard way via a cleaning station. The electrostatic process begins anew thereafter by charging the photoconductor drum 10 via the charging station (not shown). Further details about this transfer printing process can be derived from U.S. Pat. No. 5,179,417, which discloses the employment of two web-shaped recording media.

In order to place the web-shaped recording medium 12 into contact or, respectively, into the immediate proximity of the surface of the photoconductor drum 10, two transfer printing jaws 18 and 20 are provided as a guide means, these being shown in FIG. 1 in their condition wherein they are pivoted toward the photoconductor 10.

When no transfer printing event is to take place, then these transfer printing jaws 18 and 20 can be pivoted away from the photoconductor drum 10, whereby the recording medium 12 is entrained. The type of drive of the transfer printing jaws 18 and 20 and the appertaining conveyor devices for the recording medium 12 are disclosed in greater detail in U.S. Pat. No. 4,131,358.

The end 22 of the transfer printing jaw 18 delivering the recording medium 12 plays a critical part in the prior art. The feed direction for the recording medium 12 derives from the movement of the photoconductor drum 10, as indicated with an arrow P1. This end 22 cannot be brought into intimate contact with the photoconductor drum 10 since the risk of damage to the sensitive surface of the photoconductor drum 10 is too high. On the other hand, the recording medium 12 must have this contact with the surface of the photoconductor drum 10 in order to transfer the toner particles. When, then, the carrier material has slight defects or irregularities, then these have an especially critical effect at the end 22, so that the transfer of the toner particles does not ensue uniformly. For example, air bubbles can arise between the underside of the recording medium 12 and the surface of the photoconductor drum, these leading to a loss of contact or even preventing the toner transfer. Moreover, lack of roundness and ripple of the cylindrical surface of the photoconductor drum 22 have a negative effect since the spacing between the end 22 and the surface of the photoconductor drum 10 fluctuates.

FIG. 2 shows a solution from the prior art, as disclosed by U.S. Pat. No. 5,400,125 of the same assignee. This document, which shows further details of the transfer printing station that is relevant here, is thus incorporated into this patent application by reference as a source of disclosure. The known solution employs a blade-like contact pressure element 24 that is arranged at the end of the transfer printing jaw 18 and produces a defined contact between the recording medium 12 and the surface of the photoconductor drum 10 with its blade edge. This solution has definitely proven itself in practice, but it should be cited as disadvantages that the contact pressure element 24 wears over time and must be replaced, as a result whereof the printing process is interrupted. Print image errors arise given a high degree of wear of the contact pressure element 24. Further, abrasion arises at the contact pressure element 24 and at the recording medium 12, which leads to contamination and to a further source of disruption.

FIG. 3 shows an exemplary embodiment of the invention in a perspective view, whereby identical parts are identically referenced. As can be seen, a contact pressure roller 26 that extends over the entire length of the photoconductor drum 10 is seated on the transfer printing jaw 18. Supporting rollers 28 that rotate together with the transfer printing drum are attached to the outer ends thereof. The transfer printing jaw 18 can be pivoted away from the surface of the photoconductor drum 10 around a rotational axis 19 and can in turn be pivoted toward it, whereby the contact pressure roller 26 executes movements according to the arrows P2 and P3. The supporting rollers 28 have a diameter that is dimensioned such that they roll on the outermost sections on the surface of the photoconductor drum 10 during the transfer printing event. In order to achieve this, the radius of the supporting rollers must be slightly larger than the sum of the radius of the contact pressure roller 26 and the thickness of the recording medium. For a paper having a thickness of less than 1/10 mm given a paper weight of 35, 70 through 160 g, the difference between the radii of supporting roller 28 and contact pressure roller 26 should be about 15/100±10%.

What is achieved by the supporting rollers 28 is that, on the one hand, the recording medium 12 is brought into a defined proximity of the photoconductor drum 10, whereby the rolling friction between recording medium 12 and contact pressure roller 26 is minimal. On the other hand, what the supporting rollers 28 effect is that, even given a recording medium 12 whose width is less than the length of the photoconductor drum 10 viewed in longitudinal axis, damage to the light-sensitive surface does not occur. Arbitrary web widths can thus be transfer-printed, which is advantageous particularly given a great length of the photoconductor drum 10.

As can also be seen on the basis of FIG. 3, the recording medium has two webs 12A and 12B that are arranged side-by-side. The illustrated transfer printing station is thus suited for utilization in what is referred to as duplex mode, whereby one web of the recording medium is printed on the one side, the web—following thermal fixing—is turned over by 180° and supplied to the same transfer printing with the other side and then transfer-printed. Given such an operating mode, thus, a first, as yet unprinted web 12A and a web 12B that has already been printed are supplied to the transfer printing station. Due to the thermal fixing, the web 12B that has already been printed often has ripples and a different surface quality. What is achieved by the contact pressure roller 26, then, is that, even given two webs with different surfaces and different properties that lie side-by-side, both webs nonetheless lie uniformly and smoothly on the surface of the plhotoconductor drum 10, so that an immaculate transfer printing can ensue. Since the supporting rollers 28 roll on the surface of the photoconductor drum, deviations in shape from the ideal cylindrical shape have no influence; on the contrary, the contact pressure roller 26 is always held at the same distance from the surface of the photoconductor drum 10 even given ripple and lack of roundness thereof. The width of the transfer printing jaw 18 and of the contact pressure roller 26 as well as the length of the photoconductor drum 10 arc typically dimensioned such that two DIN-A4 webs in width format can be simultaneously transfer-printed side-by-side. It must also be pointed out that the arrangement with the contact pressure roller 26 also proves advantageous in other operating modes, for example in simplex printing with recording medium webs lying side-by-side and spot color printing without turning the recording medium webs over or, on the other hand, in duplex printing on a paper web with two printers that are coupled via a turn-over station.

In order to eliminate electrostatic charges from the surface of the recording medium 12A and 12B, the contact pressure roller 26 has a conductive surface of, for example, metal. This conductive surface is electrically connected to ground potential, as indicated at 30 in FIG. 3.

Figure 4:
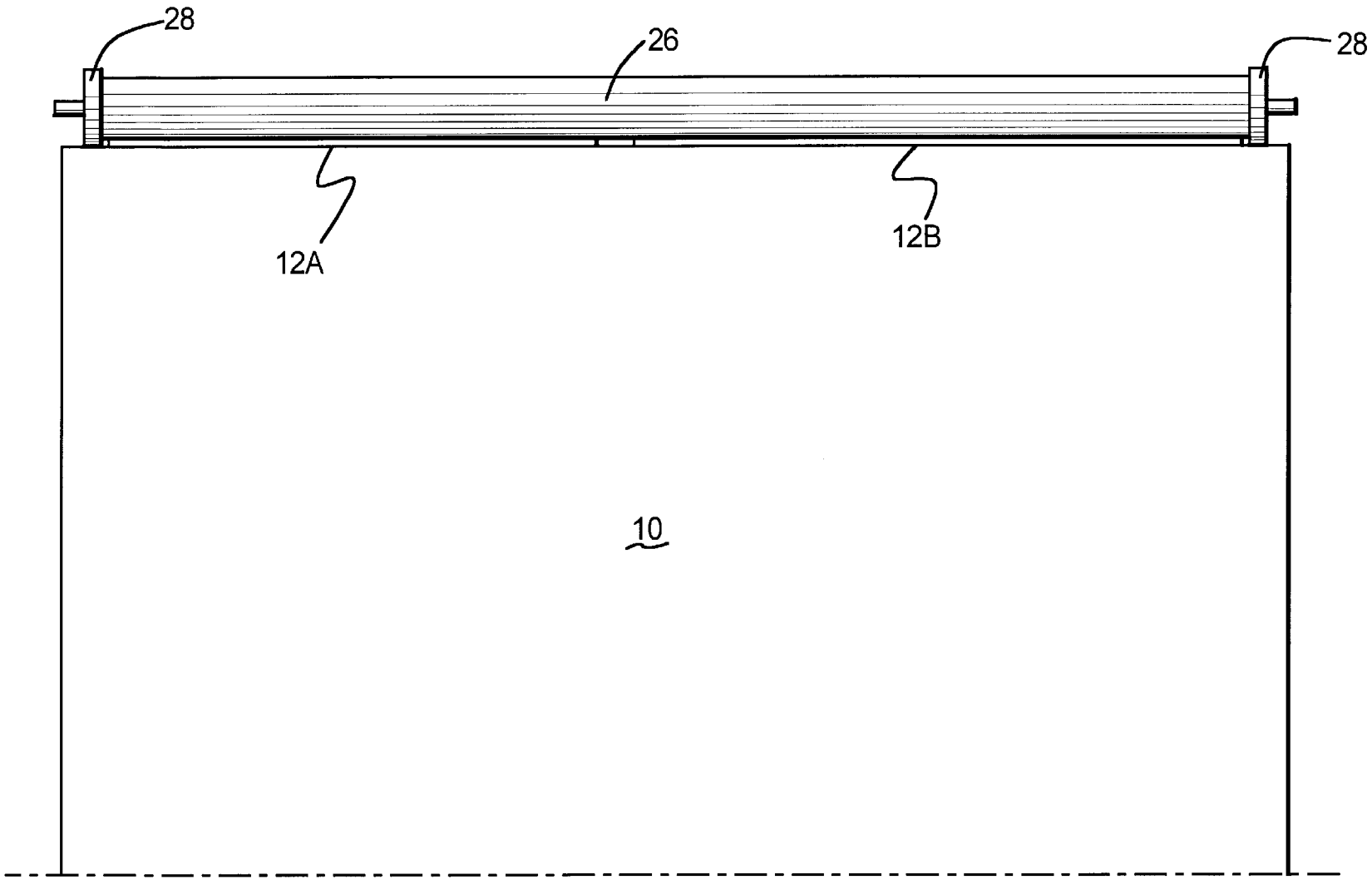
FIG. 4 is a view of the structure of FIG. 3 seen from the side.

FIG. 4 shows an illustration of the embodiment of FIG. 3 seen from the side. It can be seen that the supporting rollers have a slightly larger diameter than the contact pressure roller 26 itself.

Figure 5:
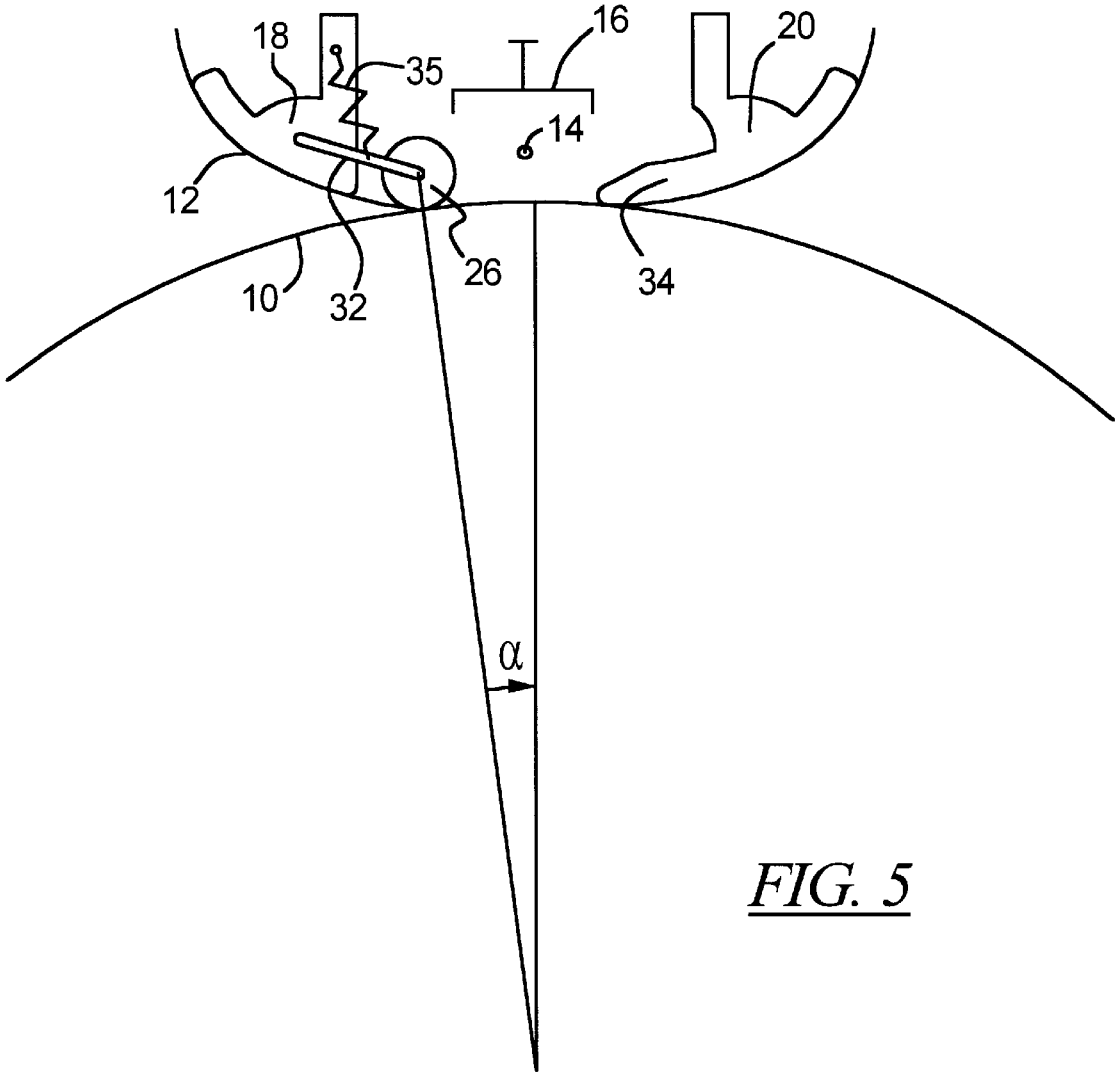
FIG. 5 is a side sectional view of exemplary embodiment with contact pressure rollers seated on springs.

FIG. 5 shows a further embodiment of the invention wherein the contact pressure roller 26 is resiliently seated at the transfer printing jaw 18 via a turning ant 32. Identical parts are again identically referenced in this Figure, too. The right-hand transfer printing jaw has a salient guide end 34. As can be seen in FIG. 5, the contact pressure roller 26 is arranged at the transfer printing jaw 18 instead of a guide end. A pressure spring 35 biases the contact pressure roller 26 in the direction of the photoconductor drum 10. A relatively large angle a over which the recording medium 12 is in contact with the surface of the photoconductor drum IO derives due to the defined pressing power by the contact pressure roller 26. What this large angle a effects is that the transfer of toner particles onto the recording medium ensues uniformly and without spacing fluctuations between the carrier material 12 and surface of the photoconductor drum 10. A high printing quality is achieved in this way.

Figure 6:
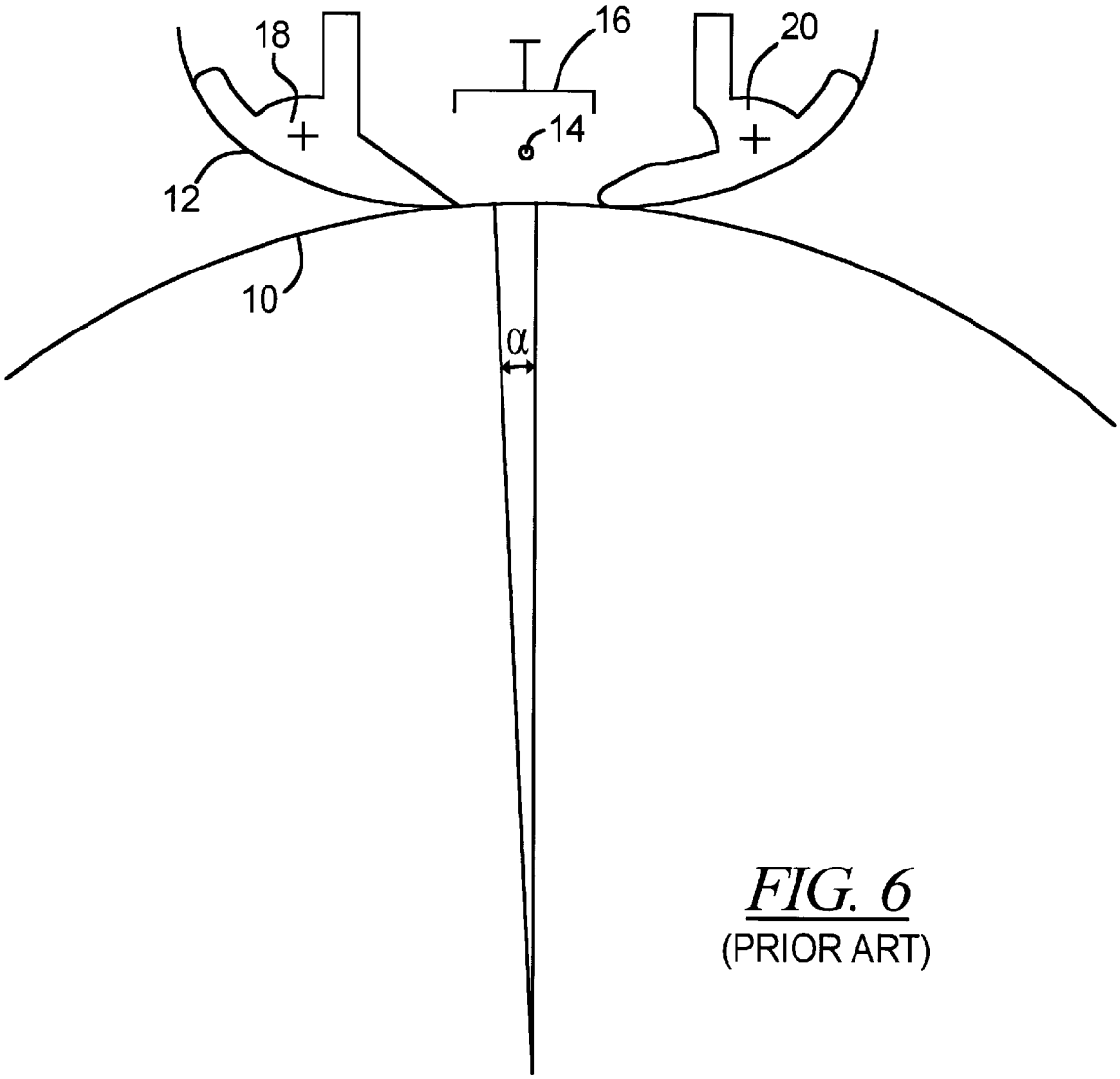
FIG. 6 (PRIOR ART)
FIG. 6 is a view corresponding to FIG. 5 and illustrating a comparison of the contact pressure angle to the Prior Art.

For comparison, FIG. 6 shows an arrangement in a traditional fashion, without the contact pressure roller. The angle o over which contact ensues between the recording medium 12 and the surface of the photoconductor drum 10 is clearly reduced.

Figure 9:
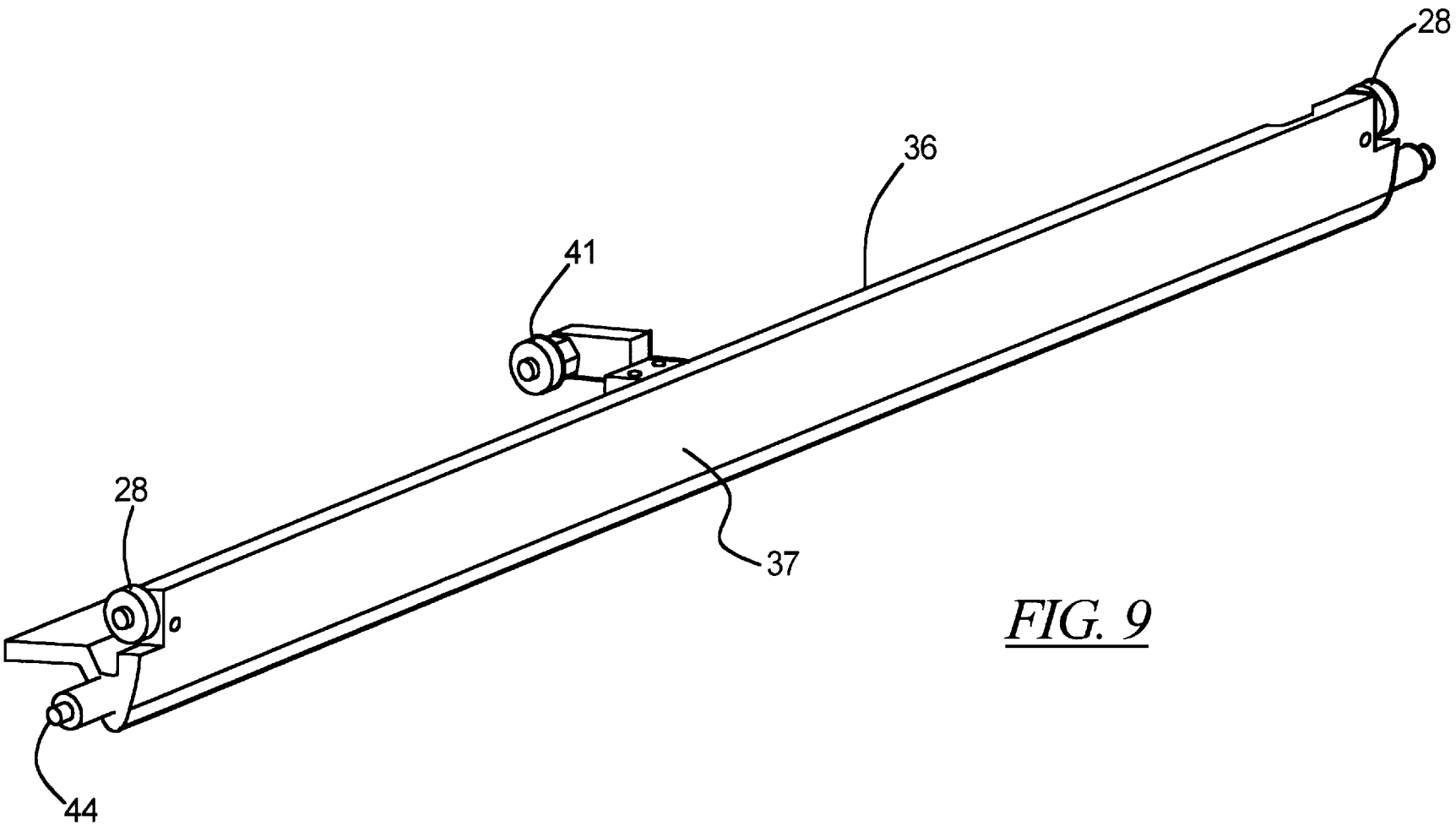
FIG. 9 is a perspective a schematic illustration of a transfer printing jaw with integrated contact pressure rail and supporting rollers.

FIGS. 7 through 9 show another advantageous example of a transfer printing station, whereby a contact pressure rail 36 is provided instead of the contact pressure roller. The contact pressure rail 36 is a component part of the transfer printing jaws 18 and 20 and is composed of a profile of polished steel with a glide surface 37 (see FIG. 9) for the recording medium formed thereon. It extends over the entire width of the writeable area of the intermediate carrier composed of a photoconductor drum 10. Supporting rollers 28 are arranged at both sides of the contact pressure rail, these being rubberized at their circumference. They interact with corresponding areas of the photoconductor drum arranged outside the actual writing area. The contact pressure rail is especially resistant to bending as a result of the profiling. The transfer printing gap of approximately 0.15 mm in this case can be adhered to all the more exactly the more resistant to bending the profile of the contact pressure rail or—in the case of the exemplary embodiment of FIG. 3—the contact pressure roller 26 is. The glide surface 37 has a large delivery radius, particularly in the region of the transfer printing jaw 18 that supplies the recording medium 12 to the transfer printing area. In this way and corresponding to the illustration of FIG. 8, it is possible to displace the contact pressure point 38 of the recording medium 12 (paper) approximately 4.6 mm closer to the transfer printing area with reference to the position of the contact pressure point 39 given the employment of a contact pressure roller 26 (FIG. 3). Creases in the paper (recording medium) are thus smoothed to a significantly greater extent. This is particularly advantageous given what is referred to as PTL paper transport (pinless transport) wherein the paper does not have any transport holes and is transported via friction rollers. The wrap forces are significantly higher here than given tractor paper conveyors.

As can be seen from FIG. 7, the contact pressure rail 36 together with the supporting rollers 28 can be a component part of the two transfer printing jaws 18 and 20; the recording medium 12 is thus guided especially well in the area of the transfer printing location or, on the other hand, can also only be a component part of the transfer printing jaw 18 that supplies the recording medium to the transfer printing location. Analogous to the exemplary embodiments with a contact pressure roller, it is also possible to arrange the contact pressure rail 36 separately from the transfer printing jaws 18 and 20.

As a result of the flexible yet rigid contact pressure rail 36 in combination with the supporting rollers, it is possible to adhere risk-free to and guarantee an extremely narrow transfer printing gap (paper transport gap) of—in this case—approximately 0.15 mm between transfer printing jaws 18 and 20 and photoconductor drum 10. Given paper tears and given absence of paper, the supporting rollers prevent damage to the photoconductor drum 10.

As can particularly be seen from the sectional view of FIG. 7, the transfer printing jaws 18 and 20 are seated so as to be pivotable as illustrated by the (arrows) around the turning axes 44. Via lever arms 40 and rollers 41 arranged thereon, they are supported—under the influence of a tension spring 42—on an eccentric 43 fashioned as cam plate. By turning the eccentric 43, the transfer printing jaws 18 and 20 are pivoted together with the contact pressure elements 36 arranged thereon. The tension spring 42 sees, on the one hand, to the contact with the eccentric, particularly when being pivoted out; on the other hand, it presses the recording medium 12 against the photoconductor drum 12 with a predetermined spring power via the contact pressure rails 36 or, respectively, their glide surfaces 37, whereby the supporting rollers prevent a downward transgression of the transfer printing gap width. The transfer printing jaws are thus seated displaceable relative to the surface of the photoconductor drum 12 opposite the spring power of the spring 42, so that recording media having the greatest variety of thicknesses can be processed.

The invention was described above on the basis of exemplary embodiments wherein web-shaped recording media are employed; however, given appropriate modification, it can also be employed in transfer printing stations that process single sheets.

Although other modifications and changes may be suggested by those skilled in the art, it is the intention of the inventors to embody within the patent warranted hereon all changes and modifications as reasonably and properly come within the scope of their contribution to the art.

What is claimed is:

1. A transfer printing station for an electrographic printer or copier device, comprising:

an electrographic intermediate carrier;

an electrostatic transfer printing apparatus operable to transfer a toner image generated on said electrographic intermediate carrier onto at least one recording medium in a transfer printing area of the transfer printing station;

guide elements arranged successively in a recording medium transport direction in the transfer printing area for guiding the recording medium close to said electrographic intermediate carrier during a transfer printing event;

at least one contact pressure element that is resistant to bending, said at least one contact pressure element being arranged between the guide elements displaceable relative to said electrographic intermediate carrier opposite a spring force, and said at least one contact pressure element presses the at least one recording medium against said electrographic intermediate carrier during the transfer printing event, and at least one spacer element allocated to said at least one contact pressure element and supported on the electrographic intermediate carrier for maintaining a defined minimum spacing between contact pressure element and electrographic intermediate carrier, said at least one contact pressure element being a contact pressure rail.

2. A transfer printing station according to claim 1, wherein said contact pressure rail is a flexurally rigid profile with a glide surface arranged thereon.

3. A transfer printing station according to claim 1, wherein a surface of the contact pressure element is electrically conductive and has a predetermined electrical potential.

4. A transfer printing station according to claim 1, wherein said guide elements are transfer printing jaws pivotable around an axis that are pivoted in a direction of said electrographic intermediate carrier during the transfer printing event and are pivoted away from said electrographic intermediate carrier outside the transfer printing event; and said contact pressure element is arranged at least at the transfer printing jaw supplying the recording medium.

5. A transfer printing station according to claim 4, wherein each transfer printing jaw has a contact pressure element allocated to it.

6. A transfer printing station according to claim 4, wherein the contact pressure element is part of said transfer printing jaw.

7. A transfer printing station according to claim 1, wherein the spacer element is a supporting roller.

8. A transfer printing station according to claim 7, wherein said supporting roller includes supporting rollers arranged at ends of the contact pressure element and roll on the outermost sections of the intermediate carrier.

9. A transfer printing station according to claim 1, wherein a length of the contact pressure element, of the guide elements and of said electrographic intermediate carrier is dimensioned such that two webs of recording media lying side-by-side are simultaneously transfer-printed.

10. A transfer printing station according to claim 9, wherein at least one of the two webs has already passed through a transfer printing event once.

11. A transfer printing station according to claim 1, wherein the recording medium is fashioned as a web and has already passed through a transfer printing event once.

12. A transfer printing station according to claim 1, wherein the contact pressure element is resiliently seated and the spring force biases the contact pressure element in the direction of said electrographic intermediate carrier.

13. A transfer printing station for an electrographic printer or copier device, comprising:

an electrographic intermediate carrier;

an electrostatic transfer printing apparatus operable to transfer a toner image generated on said electrographic intermediate carrier onto at least one recording medium in a transfer printing area of the transfer printing station;

guide elements arranged successively in a recording medium transport direction in the transfer printing area for guiding the at least one recording medium close to said electrographic intermediate carrier during the transfer printing event;

at least one contact pressure element that is resistant to bending, said at least one contact pressure element being arranged between the guide elements displaceable relative to said electrographic intermediate carrier opposite a spring force, and said at least one contact pressure element pressing the at least one recording medium against the intermediate carrier during the transfer printing event, and at least one spacer element allocated to said at least one contact pressure element and supported on said electrographic intermediate carrier for maintaining a defined minimum spacing between said at least one contact pressure element and said electrographic intermediate carrier, said at least one contact pressure element being a contact pressure roller that rolls on the recording medium, and a longitudinal axis of the contact pressure roller parallel to a surface of said electrographic intermediate carrier in order to keep the contact pressure roller at a same spacing from the surface of said electrographic intermediate carrier.

14. A transfer printing station according to claim 13, wherein a surface of the contact pressure element is electrically conductive and has a predetermined electrical potential.

15. A transfer printing station according to claim 13, wherein said guide elements are transfer printing jaws pivotable around an axis that are pivoted in a direction of said electrographic intermediate carrier during the transfer printing event and are pivoted away from said electrographic intermediate carrier outside the transfer printing event; and said contact pressure element is arranged at least at the transfer printing jaw supplying the recording medium.

16. A transfer printing station according to claim 15, wherein each transfer printing jaw has a contact pressure element allocated to it.

17. A transfer printing station according to claim 15, wherein the contact pressure element is part of said transfer printing jaw.

18. A transfer printing station according to claim 13, wherein the spacer element is a supporting roller.

19. A transfer printing station according to claim 18, and wherein said supporting roller includes supporting rollers arranged at ends of the contact pressure element and roll on the outermost sections of the intermediate carrier.

* * * * *